US007190263B2

(12) United States Patent
McKay et al.

(10) Patent No.: US 7,190,263 B2
(45) Date of Patent: Mar. 13, 2007

(54) UTILIZING A PORTABLE ELECTRONIC DEVICE TO DETECT MOTION

(75) Inventors: Brent M. McKay, Chandler, AZ (US); David J. Garcia, Chandler, AZ (US); Dipen T. Patel, Chandler, AZ (US); Anthony V. Skujins, Tempe, AZ (US); James E. Smith, Chandler, AZ (US); Ricardo Martinez, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 156 days.

(21) Appl. No.: 10/944,965

(22) Filed: Sep. 20, 2004

(65) Prior Publication Data

US 2006/0061654 A1 Mar. 23, 2006

(51) Int. Cl.
*G08B 1/08* (2006.01)

(52) U.S. Cl. ..... 340/539.1; 340/541

(58) Field of Classification Search ..... 340/539.1, 340/555, 541, 506, 426.1, 573.1; 348/143, 348/154; 455/575.1
See application file for complete search history.

(56) References Cited

U.S. PATENT DOCUMENTS

| | | | | |
|---|---|---|---|---|
| 6,741,171 | B2 * | 5/2004 | Palka et al. | 340/501 |
| 7,015,806 | B2 * | 3/2006 | Naidoo et al. | 340/531 |
| 2002/0005894 | A1 * | 1/2002 | Foodman et al. | 348/143 |
| 2004/0130624 | A1 * | 7/2004 | Ryley et al. | 348/155 |

* cited by examiner

*Primary Examiner*—Phung T. Nguyen

(57) ABSTRACT

A mobile telephone (105) with a camera feature (110) that functions as a motion detection device. The mobile telephone can include an image capture software routine (120) and a motion detection software routine (125). The image capture software routine can use the camera feature to automatically generate one or more time spaced images. The motion detection software routine can detect motion based upon differences between the time spaced images. The motion detection software routine can selectively utilize a multiple algorithms.

8 Claims, 3 Drawing Sheets

UTILIZING A PORTABLE ELECTRONIC DEVICE TO DETECT MOTION

BACKGROUND

1. Field of the Invention

The present invention relates to the field of security technology and mobile telephony, and more specifically utilizing portable electronic devices as motion detection devices.

2. Description of the Related Art

Surveillance systems typically include numerous peripheral devices communicatively linked to a centralized hub, or surveillance server. Peripheral devices can, for example, include motion detectors, infra-red sensors, contact disturbance sensors (like those monitoring windows and doorways), pressure sensors, sound detection monitors, video cameras, and the like. The surveillance server receives input from the peripheral devices and responsively performs one or more security tasks, like sounding an alarm, alerting a monitoring service of a potential disturbance, and other such tasks.

This conventional approach has numerous inherent shortcomings. For example, conventional peripheral devices are typically uniquely tailored surveillance, which is a relatively small market when compared to other technology based markets. As a result, peripheral devices used for security can be relatively pricy devices.

Further, peripheral devices that receive input can be severed from the surveillance server by potential intruders or natural events, resulting in undetected intrusions since the peripheral devices are typically incapable of meaningful independent action (all security tasks being performed in the surveillance server). Thus, the centralized handling of peripheral gathered input can result in a system that does not gracefully fail, but instead is either in a fully operational or a fully disabled state.

Another shortcoming is that peripheral devices are typically fixed, relatively bulky devices designed to be permanently affixed to designated locations. These locations can be surveyed by potential intruders or others having ill intent in advance of any nefarious actions, which lessens the effectiveness of the fixed peripheral devices. Additionally, as bulky fixtures, typical peripheral devices cannot be utilized by travelers, who often have heightened security needs. Currently, the security needs of travelers have been not been adequately addressed by conventional security solutions resulting in increased theft and personal danger to the travelers during their stays in temporary accommodations.

SUMMARY OF THE INVENTION

The present invention includes a method, system, and device for utilizing a camera phone as a motion detection device, which results in various advantages, including the obvious benefits of low cost, easy availability, and a significant beneficial alternative usage not possessed by a conventional motion sensor. Further, camera phones can be easily relocated, which can add a temporally shifting element to a security network having otherwise geographically fixed sensing devices. Further, since many travelers utilize camera phones, some level of security can be easily and inexpensively established (when camera phones are inventively utilized as detailed herein) by the travelers, when the travelers stay in temporary accommodations.

One aspect of the present invention can include a motion detection device that includes a mobile telephone with a camera feature. The mobile telephone can include an image capture software routine and a motion detection software routine. The image capture software routine can use the camera feature to automatically generate one or more time spaced images. The motion detection software routine can detect motion based upon differences between the time spaced images.

Other aspect of the present invention can include a surveillance system including a surveillance server that receives images from one or more remotely located camera phones. The surveillance server can automatically perform at least one surveillance task responsive to signals conveyed by the camera phones. Each camera phone can capture several time spaced images and differences between the time spaced images can be used to detect motion. The detected motion can actuate selective surveillance tasks of the surveillance server.

In one arrangement of the present invention, an embodiment can include a method for using a mobile phone as a motion detector. The method can include capturing a first image and subsequently capturing a second image using an image capture function of the mobile phone. The first image can be compared to the second image (or a plurality of previously generated images) to generate a correspondence score. A motion detection event can be invoked when the correspondence score is greater than a motion indication threshold, which can be a user configurable value. The motion detection event can trigger a previously determined programmatic action, which can also be a user configurable value. Another aspect can use this device to detect differences in items that are supposed to be the same, as opposed to only detecting "motion". For example, a system can detect changes in color, additional objects, missing objects or other detectable changes.

The previously determined programmatic action, for example, can cause the mobile phone to call a user-established telephone number and convey an indicator of the motion detection event once the call has been established. The previously determined programmatic action can also trigger an alarm to actuate proximate to the mobile phone, such that either the phone could produce an alarm or an external device triggered by the phone could produce the alarm.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate and explain various embodiments in accordance with the present invention; it being understood, however, that the invention is not limited to the precise arrangements and instrumentalities shown.

DETAILED DESCRIPTION OF THE INVENTION

Figure 1:
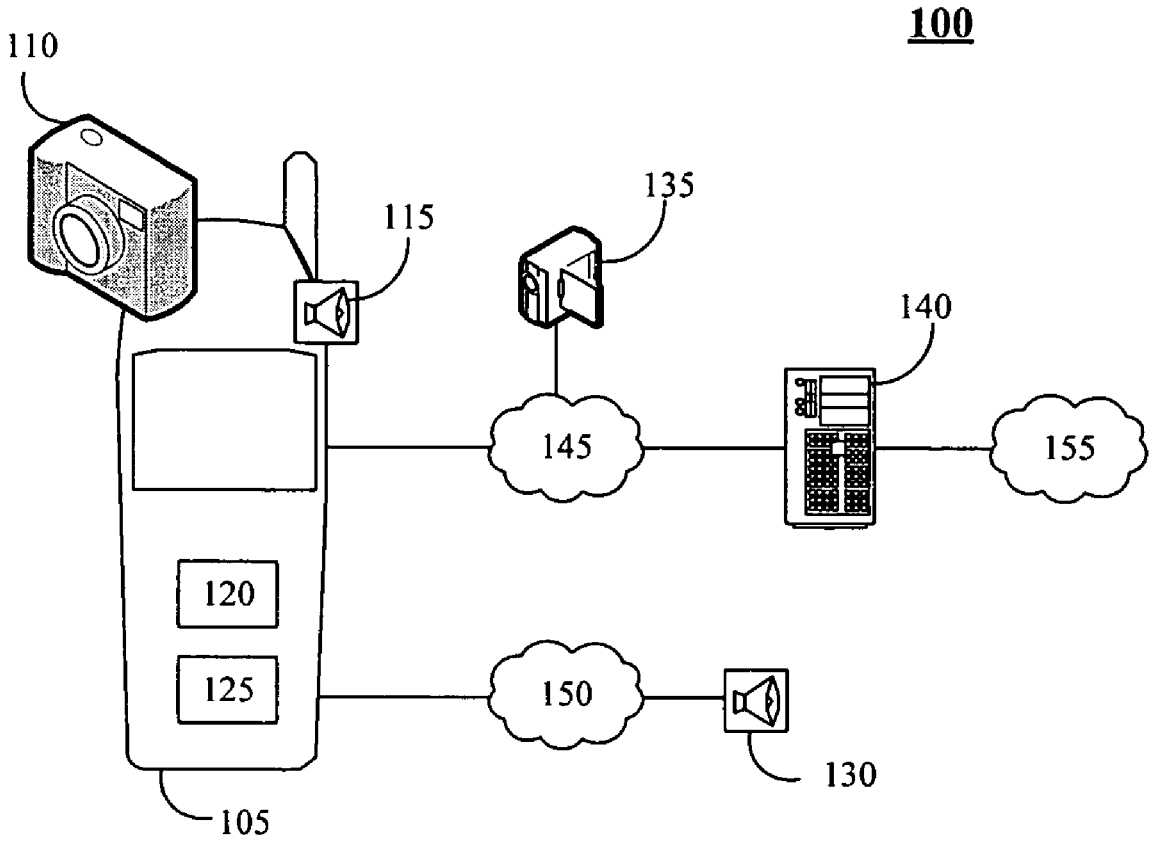
FIG. 1 is a schematic diagram illustrating a surveillance system including a camera phone that operates as a motion detection device in accordance with an embodiment of the inventive arrangements disclosed herein.

FIG. 1 is a schematic diagram illustrating a surveillance system 100 including a camera phone 105 that operates as a motion detection device in accordance with an embodiment of the inventive arrangements disclosed herein. When motion is detected by the camera phone 105, one or more automated actions can be performed. These actions include, but are not limited to, displaying an image in which the motion was detected on the phone's display, recording the image in which motion was detected to a persistent memory store, activating a phone LED, vibrating the phone, playing audio from the phone's speaker, dialing a telephone number, sending an image to a remote location, and sending a motion detection indication to a remote location.

In one arrangement, the camera phone 105 can function as a peripheral device of the system 100. In such an arrangement, the system 100 can include a surveillance server 140 that performs one or more surveillance tasks based upon input received from remote devices, that includes one or more camera phones 105 as well as other security peripherals 135. Peripherals 135 can include motion detectors, surveillance cameras, pressure sensors, temperature changes detectors, and the like.

The camera phone 105 can generate multiple time spaced images, wherein differences between the time spaced images are used to detect motion. Motion detected based on the image differences can actuate one or more surveillance tasks within the surveillance server 140. It should be appreciated that the images generated by the camera phone 105 can be processed within the camera phone 105, within the surveillance server 140, within other networked devices (not shown), and combinations thereof.

In another arrangement, the camera phone 105 can function as a stand-alone security device that need not be communicatively linked to a controlling security server 140. Further, hybrid situations exist where the camera phone 105 is neither a stand-alone security device nor a peripheral. For example, the camera phone 105 can be a cooperative device that sends motion detection information to the security server 140 as well as performs independent actions, like calling a previously determined phone number or sounding an alarm.

To perform motion detection functions, the camera phone 105 can utilize an image capture software routine 120 and a motion detection software routine 125. The image capture software routine 120 can use a camera feature 110 to automatically generate time spaced images. The image capture software routine 120 can include user configurable parameters that can affect image quality, frequency, focus, zoom, and the like.

The motion detection software routine 125 can detect motion based upon differences between the time spaced images. The motion detection software routine 125 can utilize a number of different algorithms to perform this detection. The motion detection software routine 125 can also include a number of configurable parameters for adjusting algorithm specifics.

The camera feature 110 can have one or more adjustable parameters, which can be adjusted to increase motion detection accuracy. For example, the adjustable parameters can affect zoom, focus, contrast, resolution, color and other settings resulting in differences of the images. Motion detection accuracy can be enhanced by situationally adjusting these parameters.

For example, the camera feature 110 can be initially set to a default setting at which a first and second image are captured. An initial determination can be made that motion has occurred based upon a comparison of first and second image. A suspect region of the image can be determined, where the suspect region is the region of the images having the most significant differences. Camera feature 110 settings can be modified to more accurately capture optical data concerning this suspect region. For example, the lenses of the camera feature 110 can be focused or zoomed to optimize image quality for the suspect region. A third and fourth image can then be taken at the newly adjusted settings. A comparison of the third and fourth images can be used to verify a motion event has occurred.

Messages and electronic signals can be conveyed in system 100 between the server 140 and the camera phone 105 via network 145. Additionally, the mobile phone 105 can be communicatively linked to a device 130 via network 150. Further, the surveillance tasks performed by the server 140 can result in one or more messages being conveyed to remote computing devices (not shown) linked to network 155, which can represent an Internet or an intranet.

Networks 145, 150, and 155 can be implemented in any of a variety of fashions so long as content is conveyed using encoded electromagnetic signals. Each of the networks 145, 150, and 155 can convey content in a packet-based or circuit-based manner. Additionally, each of the networks 145, 150, and 155 can convey content via landlines or wireless data communication methods.

For example, the camera phone 105 can communicate with the device 130 over a short range wireless connection (like BLUETOOTH) or a line based network connection (like USB or FIREWIRE). Similarly, the camera phone 105 can communicate with the server 140 over a wireless local area network (like WIFI using the 802.11 family of protocols) or can communicate over a mobile telephony link.

It should be appreciated that the arrangements shown in FIG. 1 are for illustrative purposes only and that the invention is not limited in this regard. The functionality attributable to the various components can be combined or separated in different manners than those illustrated herein. For instance, the image capture software routine 120 and the motion detection software routine 125 can be implemented as a single integrated software routine in one embodiment of the invention disclosed herein.

Figure 2:
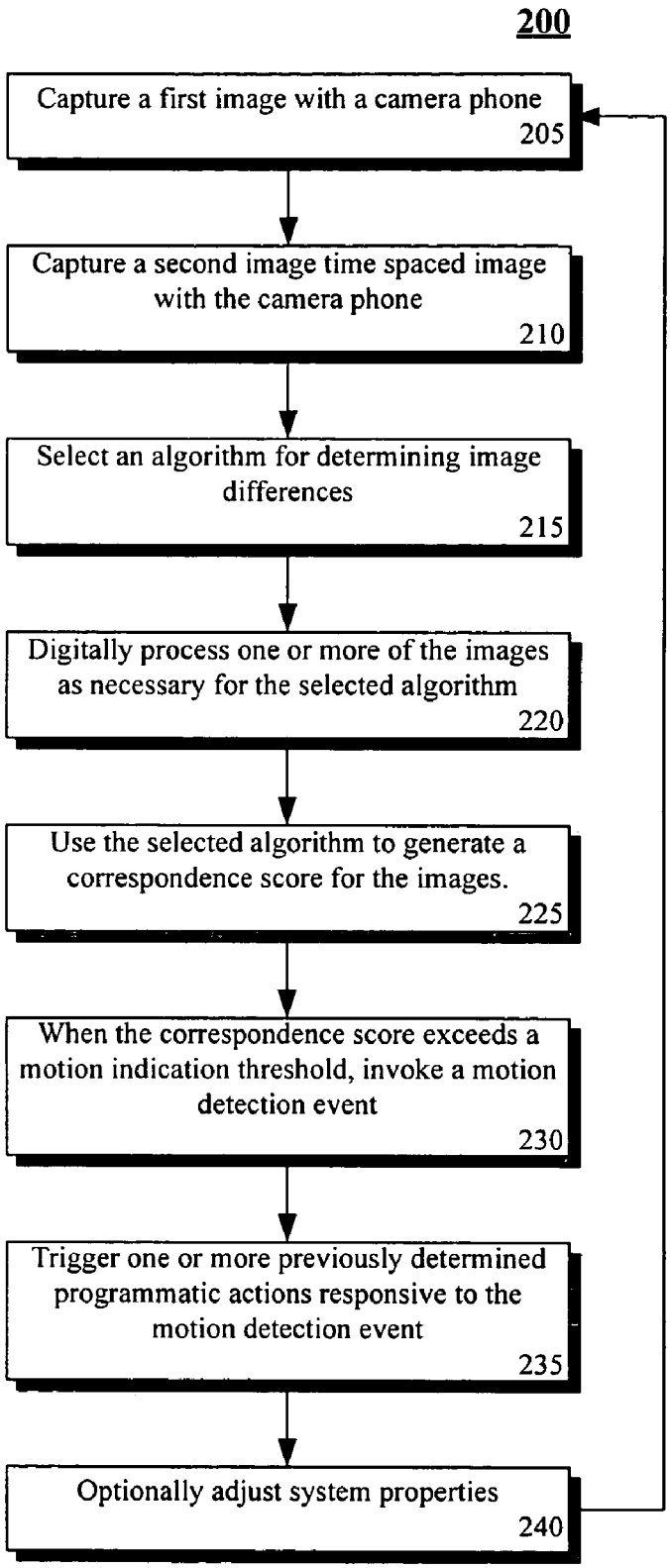
FIG. 2 is a flow chart of a method for utilizing a mobile phone as a motion detector in accordance with an embodiment of the inventive arrangements disclosed herein.

FIG. 2 is a flow chart of a method 200 for utilizing a mobile phone as a motion detector in accordance with an embodiment of the inventive arrangements disclosed herein. The method can be used in the context of a variety of surveillance environments, such as system 100 of FIG. 1.

Method 200 can begin in step 205, where a first image is captured using a camera phone. In step 210, a second image can be captured with the same camera phone, where the second image is time spaced from the first image. The time spacing between the first and second image can be adjusted to suit the surveillance monitoring needs of the environment in which the method 200 is implemented.

In step 215, an algorithm can be selected for determining differences between the first and second images. Each algorithm can utilize distinct techniques, such as determining differences based on pixel color values (like RGB values) or brightness values (or luminescence values) between the images. The algorithm selected can depend upon user preferences, camera phone capabilities, environmental conditions, and the like. Further, the algorithm selected can depend upon the location in which image processing occurs.

In optional step 220, one or more of the images can be digitally processed in accordance with the selected algorithm. For example, the images captured by the camera can be formatted to operate with the selected algorithm. Digital processing can also represent one or more pre-processing steps performed before the images are compared. Pre-processing can include such image adjustments as scaling, contrast adjustment, position normalization, and the like so that first and second images are standardized relative to one another.

In step 225, the selected algorithm can be used to generate a correspondence score for the images. In step 230, the correspondence score can be compared against a previously established motion indication threshold. When the threshold is not exceeded, there is a presumption that no motion has occurred. When the threshold is exceeded, there is a presumption that motion has occurred resulting in the invocation of a motion detection event. The motion detection event can be linked to any of a variety of programmatic actions (much like a mouse-click event or a button selection event).

In step 235, one or more previously determined programmatic actions can be responsively triggered by the occurrence of the motion detection event. The programmatic actions can result in a security intrusion event being conveyed to a remotely located device, such as a surveillance server. The programmatic actions can also result in the camera phone placing a telephony call to a designated phone number and conveying a message to the receiving party, such as playing a previously recorded voice message. The programmatic actions can further result in an alarm sounding in the area proximate to the camera phone, such as the phone ringing, vibrating, or playing an intrusion message. The programmatic actions can also store images that triggered the motion detection event, so that source of the motion can be examined.

In step 240, system properties can be optionally adjusted, and the method can loop to step 205 where the method can repeat. Any of a variety of adjustments can be performed in step 240. For example, a zoom, focus, and other optical adjustment can be performed to verify a detected event so as to improve motion detection accuracy. Further, the algorithm can be adjusted so that one algorithm is used to initially detect a motion event and a different algorithm, confirms the motion detection event. Additionally, the motion indication threshold can be adjusted. These adjustments can be made automatically, can be performed responsive to a user configuration command, or can result from a command sent to the camera phone from a remote computing device.

Figure 3:
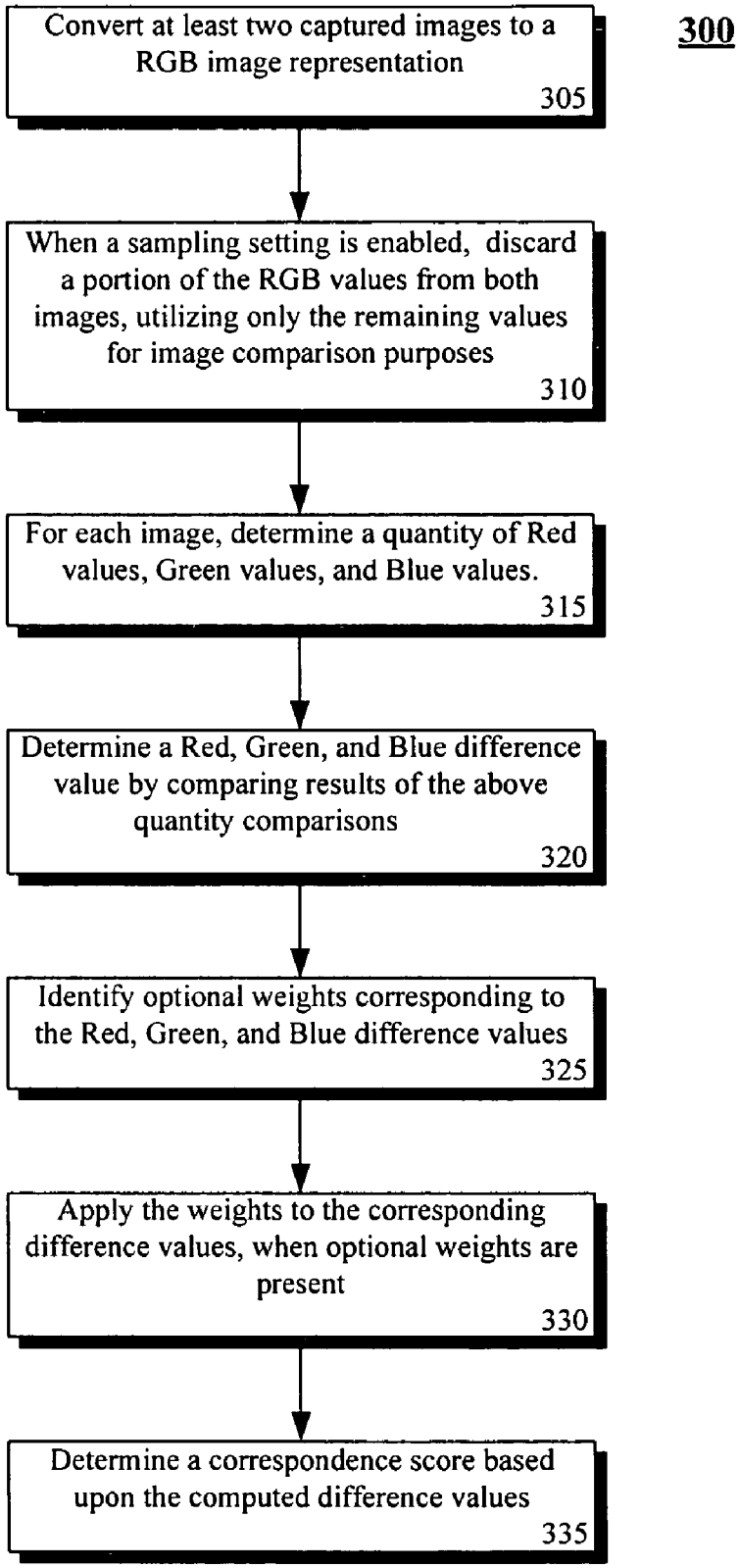
FIG. 3 is a flow chart of an algorithm for detecting motion based upon time space images captured by a mobile phone in accordance with an embodiment of the inventive arrangements disclosed herein.

FIG. 3 is a flow chart of an algorithm 300 for detecting motion based upon time space images captured by a mobile phone in accordance with an embodiment of the inventive arrangements disclosed herein. The algorithm can be performed in the context of a system that utilizes a camera phone to detection motion, such as system 100 of FIG. 1. The algorithm 300 can also represent one of the algorithms selected in step 215 of FIG. 2.

Algorithm 300 can represent a RGB summation algorithm that compares red pixels from a first image with red pixels from a second image, green pixels from the first image with green pixels from the second image, and blue pixels from the first image with blue pixels from the second image. The resulting red, green, and blue comparison values can then be summed to form an image comparison value.

Algorithm 300 can begin in step 305, where at least two captured images can be converted into a RGB image representation as necessary. Conversion is only necessary when the images are not natively stored by the camera within a RGB format.

Step 310 can represent an optional image sampling step. That is, a sampling setting can permit algorithm 300 to utilize only a portion of the red, green, and blue values present within each of the images being compared. Accordingly, in step 310, when a sampling setting is enabled, a portion of the RGB values can be discarded from both images, resulting in only the remaining values (non-discarded ones) being used for image comparison purposes.

In step 315, for each image, a quantity of red values, green values, and blue values can be determined. In step 320, differences between the quantities of red, green, and blue values of each image can be determined.

Optional step 325 can be used to selectively weigh different color pixels over others. This step can be particularly beneficial in low light situations, since a green sensor of a camera phone can be less susceptible to noise and other image degrading factors than the blue and red sensors in low light. Accordingly, the green value (recorded by the green sensor) can be given more weight in low light situations than the red and blue values.

In step 330, the weights associated with different colors can be applied. In step 335, a correspondence score can be determined by adding the difference computed between the images for red pixels, the difference computed for green pixels, and the difference computed for blue pixels.

The method 300 described abstractly above can be quantified in various formulas. One such formula is:

$$Pdiff=(|Rfirst-Rsecond|)+(|Gfirst-Gsecond|)+(|Bfirst-Bsecond|)$$

Where Pdiff represents the correspondence score, Rfirst represents the quantity of red pixels in the first image, Rsecond represents the quantity of red pixels in the second image, Gfirst represents the quantity of green pixels in the first image, Gsecond represents the quantity of green pixels in the second image, Bfirst represents the quantity of blue pixels in the first image, and Bsecond represents the quantity of blue pixels in the second image.

The following formula is similar to the above, except it includes optional weights Wred, Wgreen, and Wblue for weighing red, green, and blue difference values.

$$Pdiff=Wred(|Rfirst-Rsecond|)+Wgreen\ (|Gfirst-Gsecond|)+Wblue\ (|Bfirst-Bsecond|)$$

It should be appreciated that the invention is not limited to a RGB summation algorithm and that other algorithms can be used. For example, a luminance algorithm that directly compares images encoded as YUV values can be used. Such an algorithm can be especially advantageous, when the algorithm 300 is performed within a camera phone and when the camera phone natively stores images in the YUV format.

The present invention can be realized in hardware, software, or a combination of hardware and software. A system according to an exemplary embodiment of the present invention can be realized in a centralized fashion in one computer system or in a distributed fashion where different elements are spread across several interconnected computer systems. Any kind of computer system—or other apparatus adapted for carrying out the methods described herein—is suited. A typical combination of hardware and software could be a general-purpose computer system with a computer program that, when being loaded and executed, controls the computer system such that it carries out the methods described herein.

The present invention can also be embedded in a computer program product, which comprises all the features enabling the implementation of the methods described herein, and which—when loaded in a computer system—is able to carry out these methods. Computer program means or computer program in the present context mean any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include non-volatile memory, such as ROM, Flash memory, Disk drive memory, CD-ROM, and other permanent storage. Additionally, a computer medium may include, for example, volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A motion detection device comprising:

a mobile telephone with a camera feature, said mobile telephone comprising an image capture software routine and a motion detection software routine, wherein said image capture software routine is configured to use the camera feature to automatically generate a plurality of time spaced images, and wherein the motion detection software routine is configured to detect motion based upon differences between the plurality of time spaced images, wherein the motion detection software routine is configured to selectively utilize a plurality of different algorithms, wherein one of the plurality of algorithms used by the motion detection software routine comprises a RGB summation algorithm, said RGB summation algorithm comparing images encoded as an array of red, green, and blue values.

2. The motion detection device of claim 1, wherein the motion detection device is communicatively linked to a surveillance server via a wireless local area network, said surveillance server configured to automatically perform at least one surveillance task responsive to signals received front the motion detection device.

3. The motion detection device of claim 1, wherein the image capture software routine is configured to adjust at least one of focus and zoom associated with the camera feature.

4. The motion detection device of claim 1, wherein said RGB summation algorithm utilizes only a portion of the red, green, and blue values present within each of the images being compared.

5. The motion detection device of claim 1, wherein said RGB summation algorithm calculates the differences between a first one of the plurality of time spaced images and a second one of the plurality of time spaced images by comparing a quantity of red values present in the first image with a quantity of red values present in the second image, by comparing a quantity of green values present in the first image with a quantity of green values present in the second image, and by comparing the quantity of blue values present in the first image with a quantity of blue values present in the second image.

6. The motion detection device of claim 5, said RGB summation algorithm calculating a difference (Pdiff) between the first image (first) and the second image (second) using red (R) green (G) and blue (B) value correlations based upon the formula:

$$Pdiff=(|R\text{first}-R\text{second}|)+(|G\text{first}-G\text{second}|)+(|B\text{first}-B\text{second}|).$$

7. The motion detection device of claim 5, said RGB summation algorithm calculating a difference (Pdiff) between the first image (first) and the second image (second) using red (R) green (G) and blue (B) values based upon the formula:

$$Pdiff=W\text{red}(|R\text{first}-R\text{second}|)+W\text{green}(|G\text{first}-G\text{second}|)+W\text{blue}(|B\text{first}-B\text{second}|),$$

where Wred, Wgreen, and Wblue are numerical weights, and wherein a least one of Wred, Wgreen, and Wblue has a different value than another one of Wred, Wgreen, and Wblue.

8. The motion detection device of claim 1, wherein one of the plurality of algorithms used by the motion detection software routine comprises a luminance algorithm, said luminance algorithm comparing images encoded in a YUV format.

* * * * *